US008613643B2

(12) United States Patent
Sugitatsu

(10) Patent No.: US 8,613,643 B2
(45) Date of Patent: Dec. 24, 2013

(54) WORK FEEDER FOR ROLLER END FACE WORKING MACHINE, ROLLER END FACE WORKING MACHINE AND ROLLERS FOR ROLLER BEARING

(75) Inventor: Satoshi Sugitatsu, Iwata (JP)

(73) Assignee: NTN Corporation, Osaka (JP)

( * ) Notice: Subject to any disclaimer, the term of this patent is extended or adjusted under 35 U.S.C. 154(b) by 204 days.

(21) Appl. No.: 13/257,658

(22) PCT Filed: Mar. 29, 2010

(86) PCT No.: PCT/JP2010/055503
§ 371 (c)(1),
(2), (4) Date: Sep. 20, 2011

(87) PCT Pub. No.: WO2010/116911
PCT Pub. Date: Oct. 14, 2010

(65) Prior Publication Data

US 2012/0009852 A1 Jan. 12, 2012

(30) Foreign Application Priority Data

Apr. 9, 2009 (JP) ..... 2009-094974

(51) Int. Cl.
*B24B 47/02* (2006.01)

(52) U.S. Cl.
USPC ..... 451/177; 451/262; 451/268; 451/269; 451/331; 451/332

(58) Field of Classification Search
USPC ..... 451/49, 51, 63, 262, 268, 269, 331, 451/332, 333, 338, 339; 269/254 CS; 72/405.03; 198/480.1, 481.1
See application file for complete search history.

(56) References Cited

U.S. PATENT DOCUMENTS

| | | | | | |
|---|---|---|---|---|---|
| 774,826 | A | * | 11/1904 | Butler | 451/109 |
| 1,053,632 | A | * | 2/1913 | Mulholland | 198/464.2 |
| 2,047,021 | A | * | 7/1936 | Friden | 83/411.6 |
| 2,874,701 | A | * | 2/1959 | Stelzer | 198/418.2 |
| 3,057,452 | A | * | 10/1962 | Dixon et al. | 198/481.1 |
| 3,392,492 | A | * | 7/1968 | Stein | 451/247 |

(Continued)

FOREIGN PATENT DOCUMENTS

| | | | |
|---|---|---|---|
| EP | 1577057 | A2 | 9/2005 |
| JP | 63-147261 | U | 9/1988 |

(Continued)

OTHER PUBLICATIONS

International Search Report of PCT/JP2010/055503, mailing date Apr. 27, 2010.

(Continued)

*Primary Examiner* — George Nguyen
(74) *Attorney, Agent, or Firm* — Westerman, Hattori, Daniels & Adrian, LLP

(57) ABSTRACT

A workpiece feeder is capable of feeding a roller to a roller end face processing machine in a stable posture, a roller end face processing machine, and a roller for a rolling bearing processed by such a roller end face processing machine are provided. The workpiece feeder for roller end face processing includes: a carrier ring having a plurality of recesses arranged in a radially-inner surface thereof at a predetermined pitch along a circumferential direction; a regulating wheel fitted into the carrier ring to form roller fitting cavities between a radially-outer surface of the regulating wheel and the plurality of recesses; a carrier support for supporting the carrier ring on a radially-outer side with respect to the plurality of recesses; and rotational force applying means for applying a rotational force to the carrier ring on the radially-outer side with respect to the plurality of recesses.

8 Claims, 8 Drawing Sheets

(56) References Cited

U.S. PATENT DOCUMENTS

| | | | | |
|---|---|---|---|---|
| 3,469,351 | A * | 9/1969 | Thielenhaus | 451/63 |
| 3,859,756 | A * | 1/1975 | Zerbola | 451/49 |
| 4,531,327 | A * | 7/1985 | Dzewaltowski et al. | 451/244 |
| 4,635,401 | A * | 1/1987 | Nakaji | 451/72 |
| 7,144,003 | B1 * | 12/2006 | Meade | 269/43 |
| 7,272,878 | B2 * | 9/2007 | Dixon | 29/263 |
| 2005/0233683 | A1 | 10/2005 | Kamamura et al. | |

FOREIGN PATENT DOCUMENTS

| | | | |
|---|---|---|---|
| JP | 11-077496 | A | 3/1999 |
| JP | 11-207578 | A | 8/1999 |
| JP | 2000-033560 | A | 2/2000 |
| JP | 2002-059345 | A | 2/2002 |
| JP | 3455411 | B2 | 10/2003 |
| JP | 2005-297181 | A | 10/2005 |

OTHER PUBLICATIONS

Notification of Transmittal of Translation of the International Preliminary Report on Patentability (Form PCT/IB/338) of International Application No. PCT/JP2020/055503 mailed Nov. 24, 2011 with Forms PCT/IB/373 and PCT/ISA/237.

* cited by examiner

WORK FEEDER FOR ROLLER END FACE WORKING MACHINE, ROLLER END FACE WORKING MACHINE AND ROLLERS FOR ROLLER BEARING

TECHNICAL FIELD

The present invention relates to a workpiece feeder for roller end face processing, a roller end face processing machine, and a roller for a rolling bearing.

BACKGROUND ART

As a method of performing crowning processing on end faces of a roller, there is known processing using a double-head surface grinder and processing using a cup grinding stone. As a method of feeding a workpiece, it is general to feed a workpiece using a carrier (rotary carrier) having pockets arranged concentrically in an outer rim portion of a disk thereof.

However, the size of the carrier pocket is larger than the diameter of the workpiece, and hence a "clearance" is formed between the two (between the workpiece and the pocket), with the result that the processing position and the posture are unstable. Further, the carrier itself does not have any action of controlling the rotation of the workpiece, and the rotation depends entirely on processability of the grinding stone, with the result that stable rotation cannot be attained. Hence, uniform processing cannot be performed in a circumferential direction and runout accuracy of end faces cannot be obtained.

Therefore, in recent years, there have been developed products that enable both the end faces of the workpiece to be ground with high accuracy (Patent Literature 1 and Patent Literature 2).

Patent Literature 1 describes a double-head surface grinder. As illustrated in FIG. 11, the double-head surface grinder includes a pair of ring-like grinding stones 1, a carrier 4 arranged between the grinding stones 1, and a ring-like guide member 5 arranged on an outer periphery side of the carrier 4.

The carrier 4 has pockets 3 formed in its radially-outer surface and arranged at a predetermined pitch along the circumferential direction. Workpieces W are fitted to the pockets 3. Further, the workpieces W can be held in the pockets 3 by the guide member 5.

In this case, the guide member 5 is arranged by decentering an axis O1 of the guide member 5 from a carrier axis O by a decentering amount A so that a gap between a guide surface (radially-inner surface of the guide member 5) and the carrier 4 is smaller on a processing position H side and larger on a loading position X side opposite to the processing position H. In this case, the guide member 5 holds, together with the pocket 3, the workpiece W fed to the pocket 3 of the carrier 4 at the loading position X, and guides the workpiece W from the loading position x to an unloading position Y through the processing position H while rotating the workpiece W about its axis along with the rotation of the carrier 4.

The gap between the guide surface and the carrier 4 is larger on the loading position X side, and hence the workpiece W can be fed to the pocket 3 easily and quickly. Further, the gap between the guide surface and the carrier 4 is smaller on the processing position H side, and hence the stability of the posture of the workpiece W is enhanced, with the result that both the end faces of the workpiece W can be ground with high accuracy.

As illustrated in FIG. 12, the product described in Patent Literature 2 includes a rotatable inner disk 6, a cage 9 holding a plurality workpieces substantially equiangularly on a radially-outer portion having pocket portions 8 and a drive belt 10 stretched over radially-outer portions of the plurality of workpieces W held by the inner disk 6 and the cage 9.

Further, by rotationally driving the inner disk 6 and the drive belt 10 in opposite directions, rotational motion is applied to the workpieces W, and further, by rotating the cage 9, revolutional motion is applied to the workpieces W.

Further, cup grinding stones for processing the end faces of the workpiece W are pressed at two positions against the end faces of the workpiece W at a fixed pressure from opposite directions, and hence both the end faces of the workpiece W can be processed.

Accordingly, in the processing apparatus illustrated in FIG. 12, the end faces of the workpiece can be processed by using the elastic processing tool while rotating and revolving the workpiece. Thus, the rotation of the workpiece is kept stable, and the runout accuracy of the roller end faces can be enhanced.

By the way, there is conventionally a tangential feed grinding method using a centerless grinder (Patent Literature 3). In this case, as illustrated in FIG. 13, the centerless grinder includes a grinding wheel 11, a regulating wheel 12, and a carrier 13. Further, the centerless grinder includes a rotation shaft 12*a* and a rotation shaft 13*a* for supporting and driving the grinding wheel 11 and the carrier 13, respectively. Further, at least one end face 15 of a workpiece W fitted into a workpiece pocket 14 of the carrier 13 is in a state of being closed completely or partially.

CITATION LIST

Patent Literature

[PTL 1] JP 3455411 B
[PTL 2] JP 2005-297181 A
[PTL 3] JP 2002-59345 A

SUMMARY OF INVENTION

Technical Problems

In the product described in Patent Literature 1 above, the posture of the workpiece W is restrained by the carrier 4 and the guide member 5, and the rotation is applied to the workpiece W by the guide member 5. However, the posture of the workpiece W is stabilized only within the narrow range of the processing position. Therefore, there is a fear that the posture of the workpiece W is not stable when the workpiece W enters the processing position because the posture is unstable during transport of the workpiece W to the processing position, and an unnecessary external force is applied to the workpiece W, the carrier 4, and the guide member 5. Accordingly, the workpiece W is not sufficiently pressed against the guide member 5, and the rotation of the workpiece is also unstable, with the result that the grinding cannot be performed with high accuracy.

Further, in the product described in Patent Literature 2, the rotation is applied to the workpiece W by the drive belt 10, but the workpiece itself constitutes part of the drive system, and hence, when there is a pocket having no workpiece W fed thereto due to a feeding failure or the like, the belt 10 loses the tensile force. As a result, the drive force cannot be obtained.

Further, the carrier (cage 9) and the belt 10 come into direct contact with each other, which causes trouble such as damage to the belt.

In the case of performing the tangential feed grinding as illustrated in FIG. 13, at least one end face 15 of the workpiece W is in the state of being closed completely or partially. Therefore, both the end faces cannot be ground at the same time, which leads to lower productivity.

In view of the above-mentioned problems, the present invention has an object to provide a workpiece feeder for roller end face processing which is capable of feeding a roller to a roller end face processing machine in a stable posture, to provide a roller end face processing machine which is capable of stably and highly accurately processing both end faces of the roller fed by such a workpiece feeder for roller end face processing, and to provide a roller for a rolling bearing processed by such a roller end face processing machine.

Solution to Problems

A workpiece feeder for roller end face processing according to the present invention includes: a carrier ring having a plurality of recesses arranged in a radially-inner surface thereof at a predetermined pitch along a circumferential direction; a regulating wheel fitted into the carrier ring to form roller fitting cavities between a radially-outer surface of the regulating wheel and the plurality of recesses; a carrier support for supporting the carrier ring on a radially-outer side with respect to the plurality of recesses; and rotational force applying means for applying rotation to the carrier ring on the radially-outer side with respect to the plurality of recesses, in which, into each of the roller fitting cavities, a roller is fitted so that end faces of the roller are exposed to an outside with an axial direction of the roller being in parallel to an axial direction of the carrier ring, and in which the plurality of recesses each include an elastic member arranged therein, the elastic member being elastically brought into contact with a radially-outer surface of the roller to restrain a posture of the roller.

According to the workpiece feeder for roller end face processing of the present invention, the elastic member for restraining the posture of the roller is arranged in each of the recesses of the carrier ring, and hence the workpiece (roller) during transport can be kept in a stable posture. At this time, the carrier support and the rotational force applying means are arranged on the radially-outer side with respect to the recesses, and thus the carrier support and the rotational force applying means do not affect the exposure of the end faces of the roller to the outside.

It is preferred that the workpiece feeder for roller end face processing further include: a roller loading position, at which the roller is fittable into the each of the roller fitting cavities along the axial direction of the roller in parallel to the axial direction of the carrier ring; and an end face processing position, at which both the end faces of the roller fitted into the each of the roller fitting cavities are processed, in which, at the roller loading position, a radial gap dimension of the each of the roller fitting cavities is set larger than an outer diameter of the roller, and in which, at the end face processing position, the radial gap dimension of the each of the roller fitting cavities is set substantially equal to the outer diameter of the roller.

With this structure, the roller can be fitted at the loading position along the axial direction of the roller in parallel to the axial direction of the carrier ring. In addition, at the roller loading position, the radial gap dimension of the roller fitting cavity is larger than the outer diameter of the roller, and hence the fitting property (loading property) of the roller into the fitting cavity can be enhanced. Further, at the end face processing position, the radial gap dimension of the roller fitting cavity is set substantially equal to the outer diameter of the roller, and hence, at the end face processing position, the radial "clearance" in the fitting cavity is eliminated.

It is preferred that the roller loading position and the end face processing position be situated opposite to each other by 180 degrees across an axis of the carrier ring, and the workpiece feeder for roller end face processing further include a roller unloading position, at which the roller is unloadable along the axial direction of the roller in parallel to the axial direction of the carrier ring, the roller unloading position being situated at a position spaced apart from the end face processing position by 90 degrees along a rotation direction of the carrier ring.

The rotational force applying means may apply the rotational force by driving a belt or a roller.

A first roller end face processing machine according to the present invention includes: the workpiece feeder for roller end face processing described above; and a double-head grinder including a pair of grinding stones for grinding the end faces of the roller.

A second roller end face processing machine according to the present invention includes: the workpiece feeder for roller end face processing described above; and a cup grinding stone for grinding the end faces of the roller.

A roller for a rolling bearing according to the present invention is obtained by processing both end faces thereof in the roller end face processing machine described above.

Advantageous Effects of Invention

According to the present invention, the end faces of the roller are exposed to the outside with the axial direction of the workpiece (roller) being in parallel to the axial direction of the carrier ring. Accordingly, it is possible to obtain a sufficient region in which the end faces of the roller interfere with the surfaces of the grinding stones, and to process both the end faces of the roller uniformly at the same time with high accuracy, with the result that the grinding processing is stabilized. Further, the workpiece (roller) during transport can be kept in a stable posture. Accordingly, it is possible to process the end faces of the workpiece (roller) in the state of the stable posture, and thus the processing can be performed with high accuracy.

At the loading position, the radial gap dimension of the roller fitting cavity is set larger than the outer diameter of the roller, and hence the fitting property of the roller into the fitting cavity can be enhanced, with the result that working efficiency can be enhanced. Further, at the end face processing position, the radial gap dimension of the roller fitting cavity is set substantially equal to the outer diameter of the roller, and hence the "clearance" of the roller at the end face processing position is eliminated. Thus, there is no backlash at the time of processing the end faces, and the stable posture can be maintained, with the result that the processing can be performed with high accuracy.

The roller loading position and the end face processing position are situated opposite to each other by 180 degrees across the axis of the carrier ring, and hence the loading property of the roller at the roller loading position and the processability at the end face processing position can be enhanced. Further, the unloading position is provided at the position spaced apart from the end face processing position by 90 degrees along the rotation direction of the carrier ring, and hence the unloading property of the roller at the unloading position after the processing can be enhanced.

The rotational force applying means may apply the rotational force by driving a belt or a roller, and hence various existing apparatuses may be used therefor.

The roller end face processing machine may include the double-head grinder or the cup grinding stone, and the grinding can be performed with high accuracy irrespective of which of the two is used. In addition, an existing double-head grinder or cup grinding stone may be used, with the result that cost reduction can be achieved.

The roller for a rolling bearing processed as described above is a high-quality roller, and hence the rolling bearing using such a roller exerts a function as a bearing with high accuracy.

DESCRIPTION OF EMBODIMENT

Hereinbelow, an embodiment of the present invention is described with reference to FIGS. 1 to 9.

Figure 1:
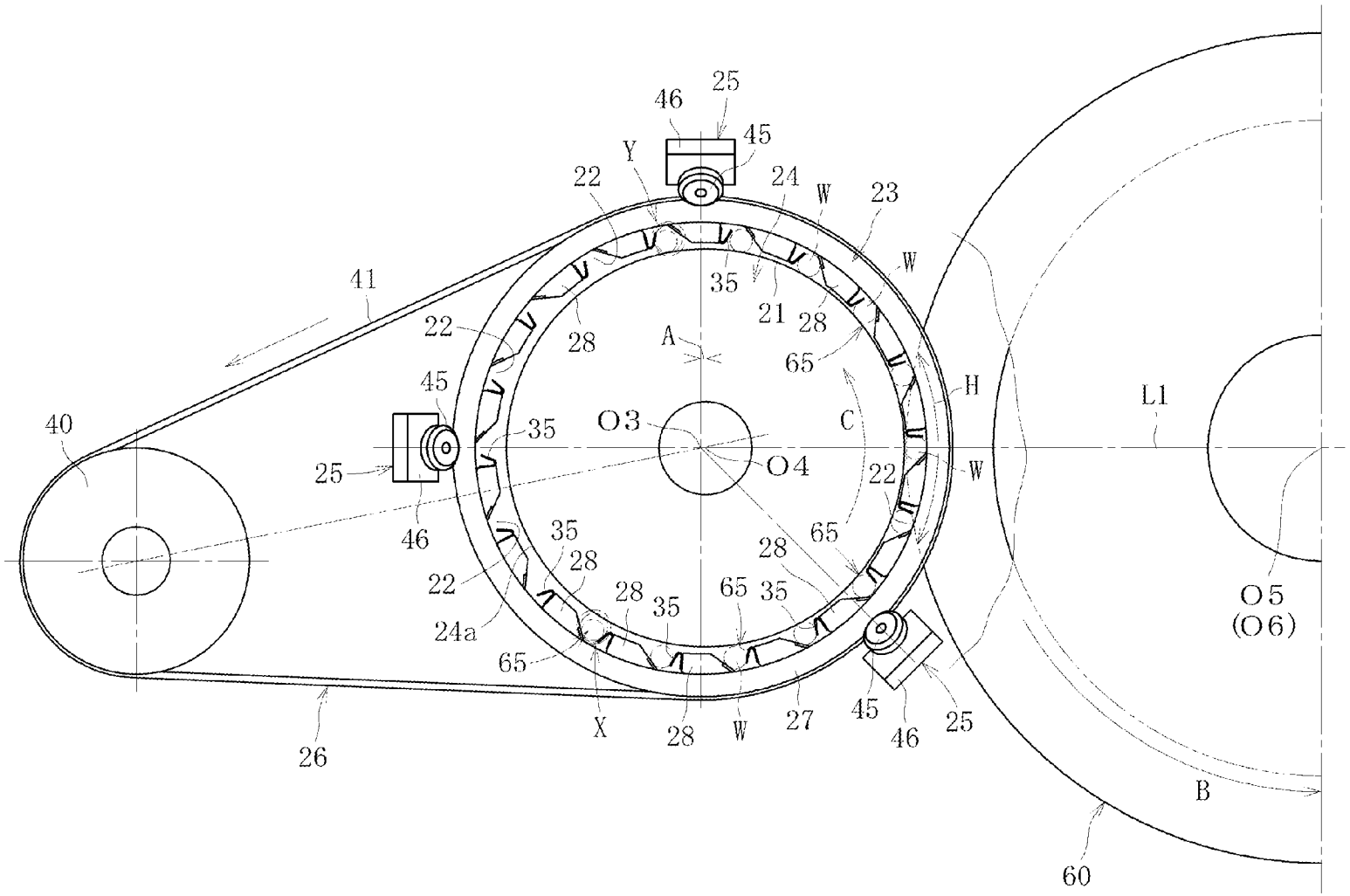
[FIG. 1] A schematic view of a roller end face processing machine using a feeder for roller end face processing according to the present invention.
Figure 2:
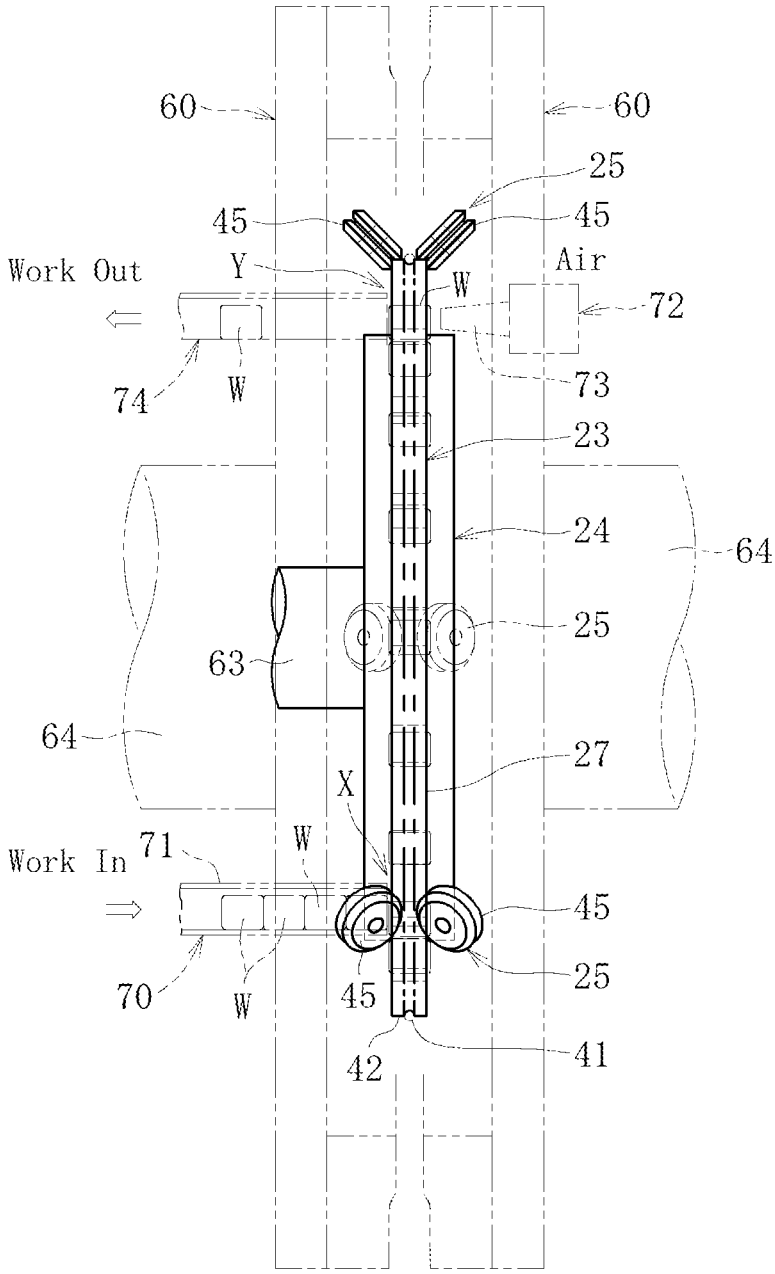
[FIG. 2] A side view of the feeder for roller end face processing.

FIGS. 1 and 2 illustrate a roller end face processing machine using a workpiece feeder for roller end face processing according to the present invention. The workpiece feeder for roller end face processing includes a carrier ring 23 having a plurality of recesses 22 arranged in its radially-inner surface 21 at a predetermined pitch along a circumferential direction, a regulating wheel 24 fitted into the carrier ring 23, carrier supports 25 for supporting the carrier ring 23 on a radially-outer side with respect to the recesses 22, and rotational force applying means 26 for rotating the carrier ring 23.

Figure 3A:
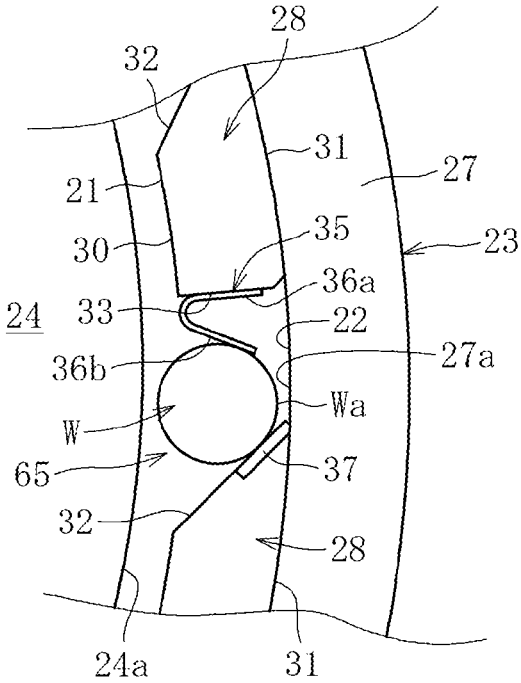
[FIG. 3A] An enlarged view of a loading position of the feeder for roller end face processing.
Figure 3B:
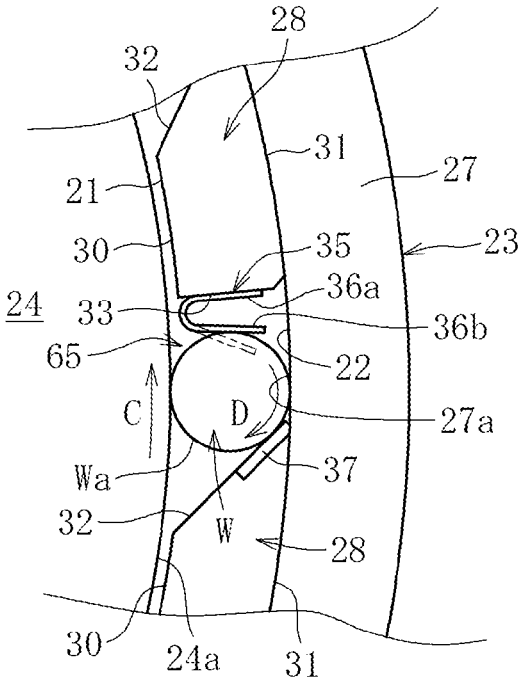
[FIG. 3B] An enlarged view of a processing position of the feeder for roller end face processing.

The carrier ring 23 includes a main body 27 formed of a ring member, and a plurality of workpiece receivers 28 arranged on a radially-inner surface of the main body 27 along the circumferential direction. Therefore, the recesses 22 are each formed between the workpiece receivers 28 adjacent in the circumferential direction. As illustrated in FIGS. 3A and 3B, the workpiece receivers 28 are each constituted by an upper base 30, a lower base 31, one side surface 32 set as an inclined surface, and another side surface 33 that forms a right angle with respect to the upper base 30 and to the lower base 31. Further, elastic members 35 are arranged in the recesses 22. The elastic members 35 each have a substantially V-shape in cross section in a free state, and one side piece 36*a* thereof is fixed to the side surface 33 of the workpiece receiver 28. Note that, a reinforcing material 37 is arranged in the one side surface 32 of the workpiece receiver 28 situated on the main body 27 side.

Therefore, as described later, when a workpiece (roller) W is fitted into the recess 22, another side piece 36*b* of the elastic member 35 is in a state of being pressed toward the side surface 33 of the workpiece receiver 28 by the workpiece W. Accordingly, the elastic member 35 is elastically brought into contact with a radially-outer surface Wa of the roller W to restrain the posture of the roller.

The rotational force applying means 26 includes a pulley 40, and a drive belt 41 stretched around the pulley 40 and the carrier ring 23. In this case, a circumferential recessed groove 43 (see FIG. 4 etc.) is provided in a radially-outer surface 42 of the carrier ring 23 (radially-outer surface of the main body 27), and the drive belt 41 engages with the circumferential recessed groove 43.

Further, an output shaft of a drive motor (not shown) is coupled to a shaft portion of the pulley 40 through the intermediation of a coupling mechanism. Therefore, when the drive motor is driven, the pulley 40 rotates and the rotation is transmitted to the carrier ring 23 through the drive belt 41, with the result that the carrier ring 23 rotates.

Figure 5:
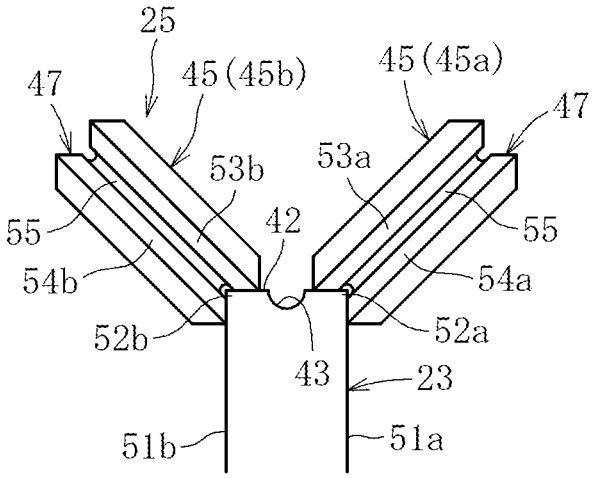
[FIG. 5] An enlarged view of a carrier support of the feeder for roller end face processing.

In this embodiment, the carrier supports 25 for supporting the carrier ring 23 are arranged at three points along the circumferential direction with a pitch of 120 degrees. The carrier supports 25 each include a pair of rollers 45 and 45, and support members 46 and 46 for rotatably supporting the rollers 45 and 45. As illustrated in FIG. 5, the roller 45 in this case is a V-grooved roller having a circumferential groove 47 formed in its radially-outer surface. Further, the circumferential groove 47 of one roller 45*a* is fitted to a corner portion 52*a* between the radially-outer surface 42 of the carrier ring 23 and one side surface 51*a* thereof, while the circumferential groove 47 of another roller 45*b* is fitted to a corner portion 52*b* between the radially-outer surface 42 of the carrier ring 23 and another side surface 51*b* thereof. Therefore, the circumferential groove 47 of the one roller 45*a* includes a cut-out surface 53*a* held in contact with the radially-outer surface 42 of the carrier ring 23, and a cut-out surface 54*a* held in contact with the side surface 51*a* of the carrier ring 23, while the circumferential groove 47 of the another roller 45*b* includes a cut-out surface 53*b* held in contact with the radially-outer surface 42 of the carrier ring 23, and a cut-out surface 54*b* held in contact with the side surface 51*b* of the carrier ring 23. Further, small recessed grooves 55 are formed in bottom portions of the circumferential grooves 47 and 47 of the rollers 45*a* and 45*b*, respectively.

As described above, the circumferential groove 47 of the one roller 45*a* is fitted to the one corner portion 52*a* of the carrier ring 23, and the circumferential groove 47 of the another roller 45*b* is fitted to the another corner portion 52*b* of the carrier ring 23. As a result, the drive belt 41 fitted to the circumferential recessed groove 43 in the radially-outer surface of the carrier ring 23 does not mutually interfere with the rollers 45*a* and 45*b*. In other words, the rotational drive of the carrier ring 23 by the drive belt 41 is not regulated by the rollers 45*a* and 45*b*, and the support of the carrier ring 23 by the rollers 45*a* and 45*b* is not regulated by the drive belt 41. Therefore, the rotational drive of the carrier ring 23 by the drive belt 41 and the support of the carrier ring 23 by the rollers 45*a* and 45*b* are kept stable, respectively.

Figure 4:
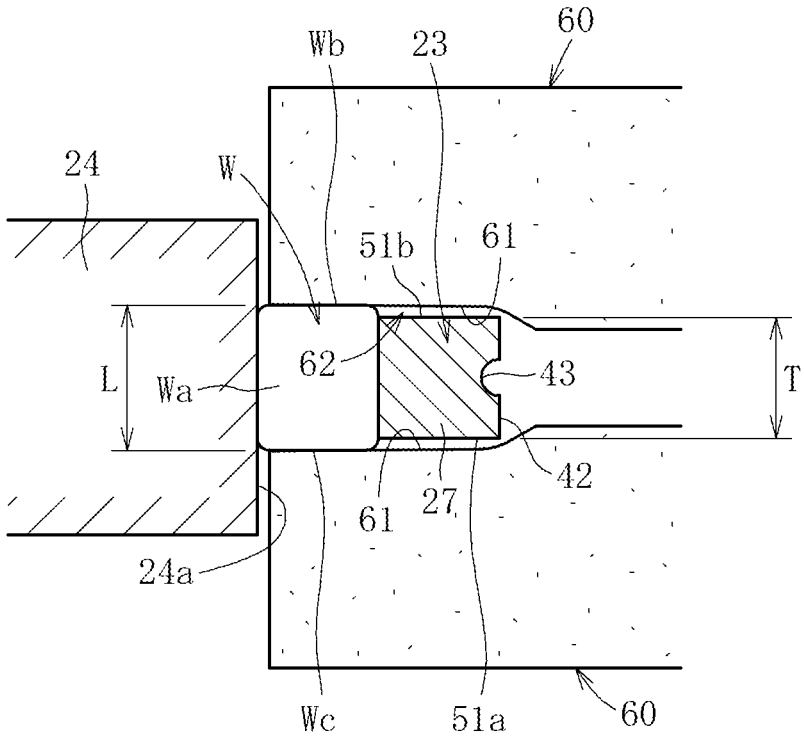
[FIG. 4] A main part enlarged view of the roller end face processing machine.

The roller end face processing machine includes a pair of grinding stones 60 and 60 arranged substantially opposite the pulley 40. As illustrated in FIG. 4, the respective grinding stones 60 and 60 grind end faces Wb and Wc of the roller W on a radially-outer side of their inner side surfaces. In this case, recessed portions 61 and 61 are formed on the radially-outer side of the inner side surfaces of the respective grinding stones 60 and 60, and the recessed portions 61 and 61 form a gap 62 to which the carrier ring 23 and the roller W are to be fitted. Further, a thickness T of the carrier ring 23 is set smaller than a linear dimension L of the roller W. With this structure, both the side surfaces 51*a* and 51*b* of the carrier ring 23 (side surfaces of the main body 27) do not come into contact with bottom surfaces of the recessed portions 61 and 61 of the respective grinding stones 60 and 60 under a state in which the end faces Wb and Wc of the roller W are held in contact with the bottom surfaces of the recessed portions 61 and 61 of the respective grinding stones 60 and 60. Note that, the respective grinding stones 60 and 60 are rotationally driven by drive means (not shown) about their axes O5 and O6 in the arrow B direction (see FIG. 1). Note that, the drive means includes a drive motor, and a transmission mechanism for transmitting a drive force of the motor to shaft portions 64 and 64 of the respective grinding stones 60 and 60. As the transmission mechanism, for example, a gear mechanism or a belt mechanism may be used.

As illustrated in FIG. 1, the regulating wheel 24 is constituted by a disk member, and an axis O4 of the regulating wheel 24 deviates from an axis O3 of the carrier ring 23. In other words, the axis O4 of the regulating wheel 24 is decentered by a predetermined decentering amount A toward the grinding stones 60 and 60. As illustrated in FIG. 1, in front view, the axis O4 of the regulating wheel 24 is arranged on a center line L1 connecting the axis O3 of the carrier ring 23 and the axes O5 and O6 of the grinding stones 60 and 60. At this time, the inner diameter of the main body 27 of the carrier ring 23 is set larger than [outer diameter of regulating wheel 24]+2×(outer diameter of roller W). Therefore, the above-mentioned decentering is possible. Further, the regulating wheel 24 is rotated by drive means (not shown) about the axis O4 thereof. Note that, the drive means may also have the same structure as the drive means for rotationally driving the grinding stones 60 and 60. Specifically, the drive means includes a drive motor, and a transmission mechanism for transmitting a drive force of the motor to a shaft portion 63 of the regulating wheel 24.

As described above, the axis O4 of the regulating wheel 24 deviates from the axis O3 of the carrier ring 23, and hence a larger part and a smaller part are defined in a gap between the radially-inner surface 21 of the carrier ring 23 (inner surfaces of the workpiece receivers 28) and a radially-outer surface 24*a* of the regulating wheel 24. In this case, the range of the larger gap is situated opposite to the grinding stone, and the range of the smaller gap is situated on the grinding stone side.

By the way, the regulating wheel 24 is fitted into the carrier ring 23, and hence fitting cavities 65, into each of which the roller W is to be fitted (loaded), are formed by the recesses 22 of the radially-inner surface 21 of the carrier ring 23 and the radially-outer surface 24*a* of the regulating wheel 24. Accordingly, the fitting cavity 65 on a side opposite to the grinding stone is larger in its radial gap dimension, and the fitting cavity 65 on the grinding stone side is smaller in its radial gap dimension.

Therefore, the part in which the fitting cavity 65 that is larger in radial gap dimension is situated, for example, a position X is referred to as roller loading position, and a position Y is referred to as roller unloading position. At the roller loading position, the roller W can be fitted along its axial direction in parallel to an axial direction of the carrier ring 23. At the roller unloading position, the roller W can be carried out along its axial direction in parallel to the axial direction of the carrier ring 23. Further, the range in which the fitting cavity 65 that is smaller in radial gap dimension is situated is referred to as processing position H.

As illustrated in FIG. 2, in the vicinity of the roller loading position X, there is arranged workpiece feeding means 70 for sequentially feeding the roller W to the fitting cavity 65 that reaches the roller loading position X. The workpiece feeding means 70 includes a roller feeding path 71 arranged in parallel to the axial direction of the carrier ring 23. The roller W fed to the feeding path 71 is pushed toward the fitting cavity 65 by a pressing mechanism (not shown) (cylinder mechanism, ball-screw mechanism, air-blow mechanism, etc.), and is loaded into the fitting cavity 65.

Further, at the roller unloading position Y, an air-blow mechanism 72 is arranged, and by an air blast from an air-blast nozzle 73 of the air-blow mechanism 72, the roller W is unloaded from the unloading position Y along its axial direction in parallel to the axial direction of the carrier ring 23. The unloaded roller W is transported to a roller unloading path 74, and is delivered to the outside through the unloading path 74.

Next, description is given of a method of grinding the end faces of the roller W by using the roller end face processing machine that is structured as described above. Under a state in which the grinding stones 60 and 60 are rotated about their axes in the arrow B direction, the carrier ring 23 and the regulating wheel 24 are rotationally driven by the rotational force applying means 26 in the arrow C direction. Under this state, the roller W is loaded into the fitting cavity 65 at the roller loading position X. At the loading position X, the radial gap dimension of the fitting cavity 65 is larger than the outer diameter of the roller W, and hence the fitting property (loading property) of the roller into the fitting cavity 65 can be enhanced.

Further, as illustrated in FIG. 3A, at the loading position X, under the state in which the roller W is loaded, the roller N is held by the side piece 36*b* of the elastic member 35 in the free state and the reinforcing material 37 with the roller W being sandwiched therebetween. Under this state, along with the rotation of the carrier ring 23, the roller W is transported from the loading position X to the processing position H. At this time, the gap between the radially-inner surface 21 of the carrier ring 23 and the radially-outer surface 24*a* of the regulating wheel 24 gradually becomes smaller, and accordingly the roller W rotates by the friction between the roller W and the radially-outer surface 24*a* of the regulating wheel 24 as indicated by the arrow D of FIG. 3B.

Further, as the cavity 65 into which the roller W is fitted becomes closer to the processing position H, the roller W is pressed toward the bottom of the recess 22, with the result that the roller W enters the recess 22 toward the bottom thereof with the radially-outer surface of the roller W pressing the another side piece 36*b* of the elastic member 35 toward the one side piece 36*a* thereof. In other words, the roller W enters the processing position H while revolving and rotating about the carrier ring 23.

Further, as illustrated in FIG. 3B, at the processing position H, the radially-outer surface Wa of the roller W is in a state of being held in slide contact with a radially-inner surface 27a of the main body 27 of the carrier ring 23 and the radially-outer surface 24*a* of the regulating wheel 24.

At the processing position H, both the end faces of the roller W are ground by the grinding stones 60 and 60, and the roller W after both the end faces Wb and We are ground is unloaded from the processing position H along with the rotation of the carrier ring 23. Specifically, by the air blast from the air-blast nozzle 73 of the air-blow mechanism 72, the roller W is unloaded from the unloading position Y along its axial direction in parallel to the axial direction of the carrier ring 23.

As described above, the roller W rotates by the friction between the roller W and the radially-outer surface 24*a* of the regulating wheel 24, and hence it is preferred that the radially-outer surface 24*a* of the regulating wheel 24 be excellent in abrasion resistance. Therefore, it is preferred that the radially-outer surface 24*a* of the regulating wheel 24 be formed of a composite material mainly containing a steel-based material and an elastomer-based material. The "elastomer" is herein a generic term of polymeric materials having a rubber-like elasticity near room temperature.

In the present invention, the elastic members 35 for restraining the posture of the rollers are arranged in the recesses 22 of the carrier ring 23, and hence the workpiece (roller) W during transport can be kept in a stable posture. It is possible to process the end faces of the workpiece (roller) W in the state of the stable posture, and thus the processing can be performed with high accuracy. At this time, the end faces of the roller are exposed to the outside with the axial direction of the workpiece (roller) W being in parallel to the axial direction of the carrier ring 23. Accordingly, it is possible to obtain a sufficient region in which the end faces of the roller interfere with the surfaces of the grinding stones, and to process both the end faces Wb and Wc of the roller W uniformly at the same time with high accuracy, with the result that the grinding processing is stabilized.

At the loading position X, the radial gap dimension of the roller fitting cavity 65 is set larger than the outer diameter of the roller, and hence the fitting property of the roller W into the fitting cavity 65 can be enhanced, with the result that working efficiency can be enhanced. Further, at the end face processing position H, the radial gap dimension of the roller fitting cavity 65 is set substantially equal to the outer diameter of the roller, and hence the "clearance" of the roller at the end face processing position H is eliminated. Thus, there is no backlash at the time of processing the end faces, and the stable posture can be maintained, with the result that the processing can be performed with high accuracy.

The roller loading position X and the end face processing position H are situated opposite to each other by 180 degrees across the axis of the carrier ring 23, and hence the loading property of the roller at the roller loading position X and the processability at the end face processing position H can be enhanced. Further, the unloading position is provided at the position spaced apart from the end face processing position H by 90 degrees along the rotation direction of the carrier ring 23, and hence the unloading property of the roller at the unloading position after the processing can be enhanced.

By the way, for the rotational force applying means 26, a so-called belt drive system is employed, but a roller raceway system may be employed instead. As the roller raceway system (not shown), the carrier ring 23 only needs to be rotated by bringing the radially-outer surface and/or the side surfaces of the carrier ring 23 into contact with a drive roller, and rotationally driving the drive roller. As described above, by employing the drive roller system, there is no need to provide, in the radially-outer surface of the carrier ring 23, the circumferential recessed groove 43 which the belt is to be fitted.

Figure 6:
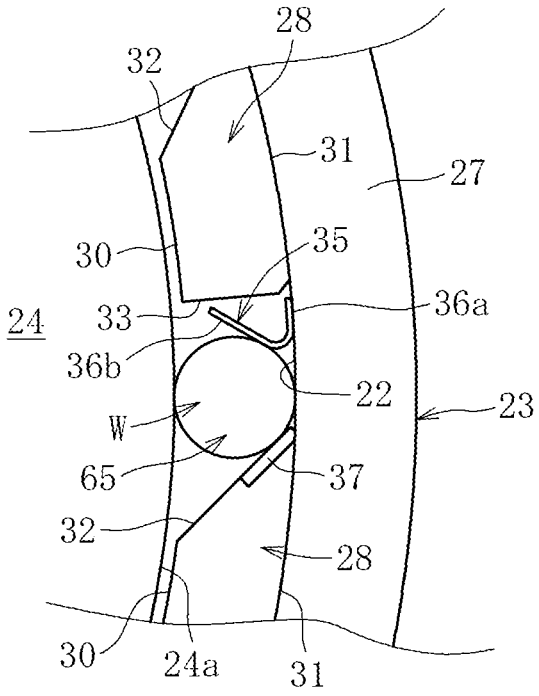
[FIG. 6] A main part enlarged view illustrating a modification example of an elastic member of the feeder for roller end face processing.

By the way, as the elastic member 35 to be arranged in the recess 22, an elastic member as illustrated in FIG. 6 may be employed. In this case, the one side piece 36*a* of the elastic member 35 is fixed to the radially-inner surface of the main body 27 of the carrier ring 23, and the another side piece 36*b* of the elastic member 35 comes into contact or press contact with the radially-outer surface of the workpiece W. Even with such an elastic member 35, the roller W during transport can be held, and in addition, the roller W rotates by the friction between the roller W and the radially-outer surface 24*a* of the regulating wheel 24.

Figure 7:
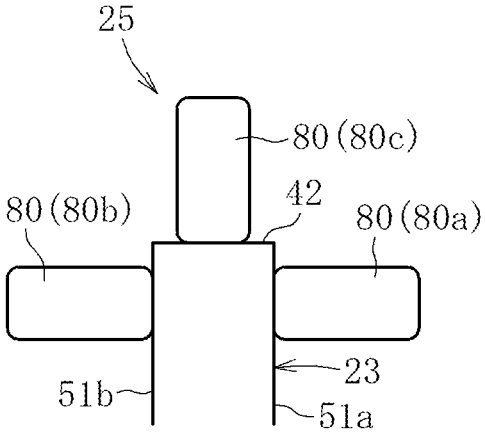
[FIG. 7] A schematic view illustrating a first modification example of the carrier support of the feeder for roller end face processing.

Further, in this embodiment, the V-grooved roller is used as the carrier support 25, but a flat roller 80 as illustrated in FIG. 7 may be used instead. In this case, three flat rollers 80 are used for one of the carrier supports 25. Specifically, the carrier support 25 includes a radially-outer surface roller 80*c* that rolls on the radially-outer surface of the carrier ring 23, a side surface roller 80*a* that rolls on the one side surface 51*a* of the carrier ring 23, and a side surface roller 80*b* that rolls on the another side surface 51*b* of the carrier ring 23.

Figure 8:
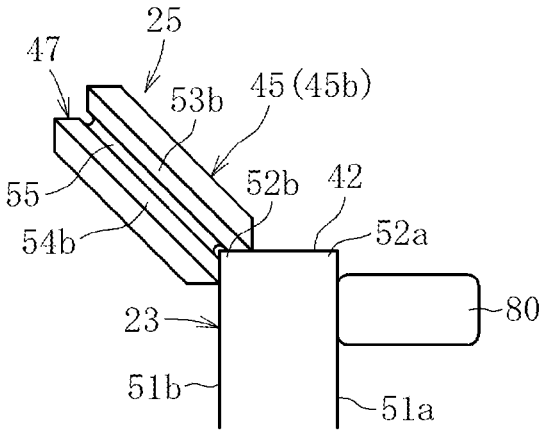
[FIG. 8] A schematic view illustrating a second modification example of the carrier support of the feeder for roller end face processing.

As illustrated in FIG. 8, the V-grooved roller 45 and the flat roller 80 may be used in combination. In this case, as the V-grooved roller 45, there is used a V-grooved roller having the circumferential groove 47 fitted to the corner portion 52*b* between the radially-outer surface 42 of the carrier ring 23 and the another side surface 51*b* thereof. In other words, the another V-grooved roller 45*b* illustrated in FIG. 5 may be used. As the flat roller 80, there is used a flat roller that rolls on the one side surface 51*a* of the carrier ring 23.

Note that, in the case where the V-grooved roller 45 and the flat roller 80 are used in combination as described above, as the V-grooved roller 45, there may be used a V-grooved roller having the circumferential groove 47 fitted to the corner portion 52*a* between the radially-outer surface 42 of the carrier ring 23 and the one side surface 51*a* thereof, and as the flat roller 80, there may be used a flat roller that rolls on the another side surface 51*b* of the carrier ring 23.

Figure 9:
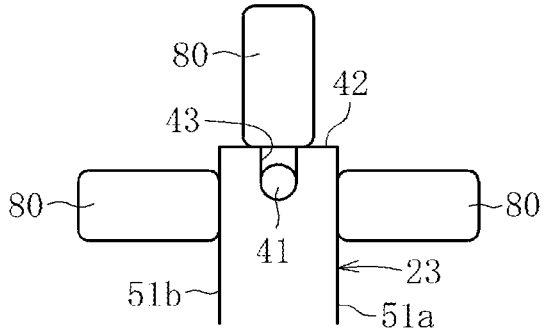
[FIG. 9] schematic view illustrating a third modification example of the carrier support of the feeder for roller end face processing.

By the way, in FIGS. 7 and 8, the circumferential recessed groove 43 is not provided in the radially-outer surface, but the circumferential recessed groove 43 may be provided instead. In the case where the flat roller 80 rolls on the radially-outer surface 42 as illustrated in FIG. 7, as illustrated in FIG. 9, the depth of the circumferential recessed groove 43 only needs to be increased so that the engaging belt 41 do not project from the radially-outer surface of the carrier ring 23.

Figure 10:
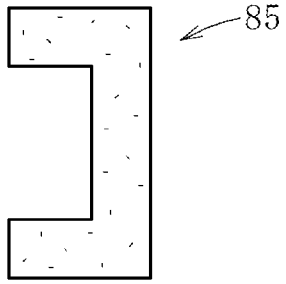
[FIG. 10] A schematic cross-sectional view of another grinding stone.
Figure 11:
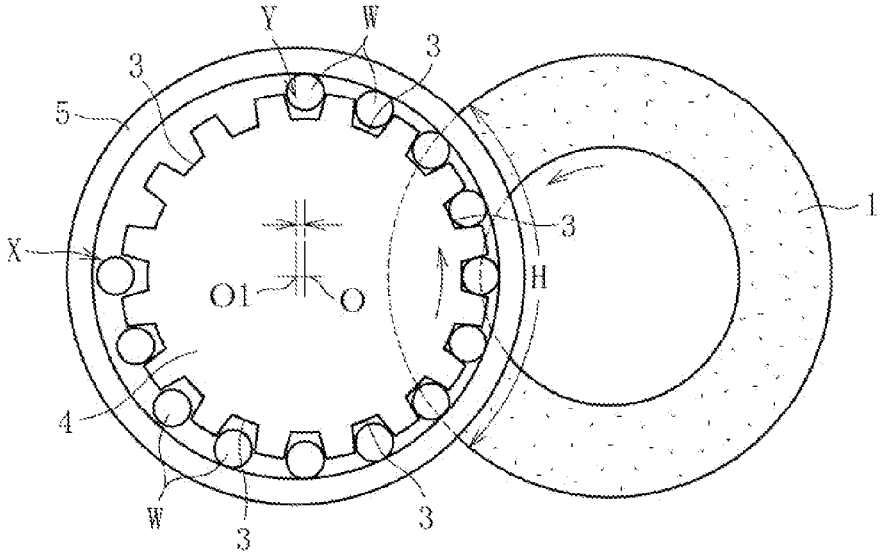
FIG. 11 (Prior Art)
[FIG. 11] A schematic view illustrating a conventional roller end face processing machine.
Figure 12:
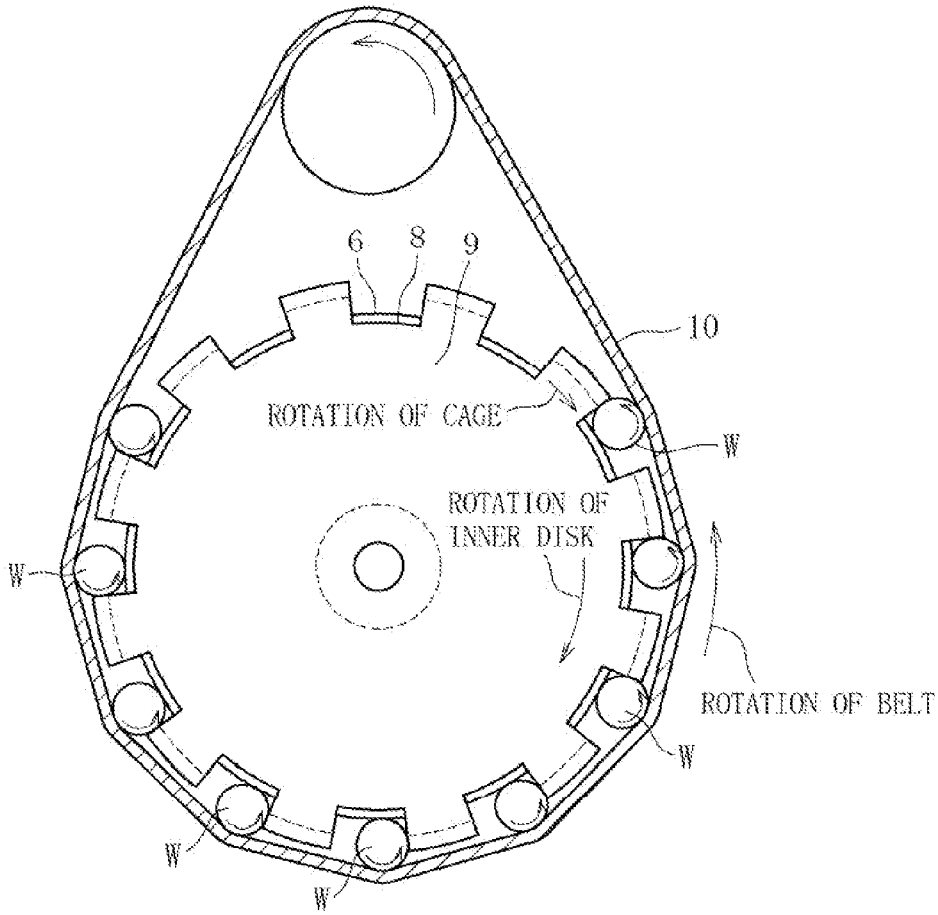
FIG. 12 (Prior Art)
[FIG. 12] A schematic view illustrating another conventional roller end face processing machine.
Figure 13:
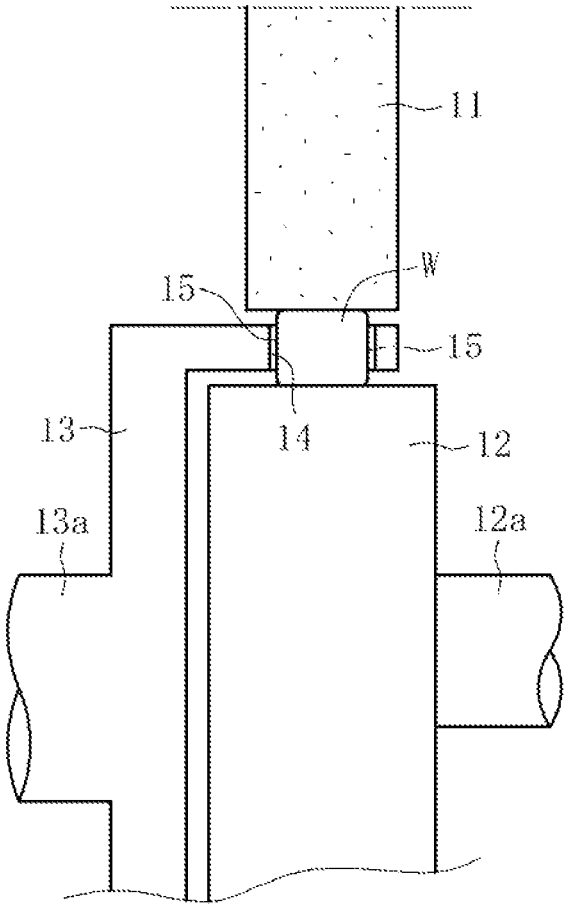
FIG. 13 (Prior Art)
[FIG. 13] A schematic view illustrating still another conventional roller end face processing machine.

Further, in this embodiment, the double-head grinder is used, but a cup grinding stone 85 as illustrated in FIG. 10 may be used instead. In this case, the number of cup grinding stones 85 may be one or two.

Hereinabove, the present invention has been described by way of the embodiment, but the present invention is not limited to the embodiment, and various modifications may be made thereto. For example, as the belt for belt-driving the carrier ring 23, any one of a flat belt, a V-belt, a round belt, and a toothed belt may be used. Further, the carrier supports 25 are not limited to the carrier supports arranged along the circumferential direction with a pitch of 120 degrees, and the number of carrier supports, the arrangement pitch thereof, and the like may be arbitrarily changed as long as the carrier ring 23 can be supported. Because the carrier support 25 only needs to support the rotational drive of the carrier ring 23, the carrier support 25 is not limited to the roller of this embodiment that is a rotatable member, and may be a slidable member. In other words, it is only necessary to come into slide contact with the radially-outer surface of the rotating carrier ring 23 or the like to support the rotational drive of the carrier ring 23 without regulating the rotational drive.

Further, in this embodiment, as illustrated in FIG. 1, the grinding stones 60 and 60 are set so as to rotate in the arrow B direction, and the carrier ring 23 and the regulating wheel 24 are set so as to rotate in the arrow C direction. Alternatively, the carrier ring 23 may be rotated in a direction opposite to the arrow C direction. In this case, the position Y serves as the roller loading position, and the position X serves as the roller unloading position. Note that, the elastic member to be arranged in the recess 22 is not limited to the spring member made of metal as illustrated in FIGS. 3 and 6, and an elastic member such as a rubber, a resin, and a sponge may be used therefor. The number of fitting cavities to be formed may arbitrarily be increased and decreased.

Industrial Applicability

It is possible to provide the roller end face processing machine for processing end faces of a roller to be used for a rolling bearing. Further, it is possible to provide the roller feeder which is capable of feeding a roller to such a roller end face processing machine. In addition, it is possible to form a roller in the roller end face processing machine.

REFERENCE SIGNS LIST

21 radially-inner surface
22 recess
23 carrier ring
24 regulating wheel
65 roller fitting cavity
H processing position
W workpiece (roller)
Wa radially-outer surface
Wb, Wc end face
X loading position
Y unloading position

The invention claimed is:

1. A workpiece feeder for roller end face processing, comprising:

a carrier ring having a plurality of recesses arranged in a radially-inner surface thereof at a predetermined pitch along a circumferential direction;

a regulating wheel fitted into the carrier ring to form roller fitting cavities between a radially-outer surface of the regulating wheel and the plurality of recesses;

a carrier support for supporting the carrier ring on a radially-outer side with respect to the plurality of recesses; and rotational force applying means for applying a rotational force to the carrier ring on the radially-outer side with respect to the plurality of recesses, wherein, into each of the roller fitting cavities, a roller is fitted so that end faces of the roller are exposed to an outside with an axial direction of the roller being in parallel to an axial direction of the carrier ring, and wherein the plurality of recesses each comprise an elastic member arranged therein, the elastic member being elastically brought into contact with a radially-outer surface of the roller to restrain a posture of the roller.

2. A workpiece feeder for roller end face processing according to claim 1, further comprising:

a roller loading position, at which the roller is fittable into the each of the roller fitting cavities along the axial direction of the roller in parallel to the axial direction of the carrier ring; and an end face processing position, at which both the end faces of the roller fitted into the each of the roller fitting cavities are processed, wherein, at the roller loading position, a radial gap dimension of the each of the roller fitting cavities is set larger than an outer diameter of the roller, and wherein, at the end face processing position, the radial gap dimension of the each of the roller fitting cavities is set substantially equal to the outer diameter of the roller.

3. A workpiece feeder for roller end face processing according to claim 2, wherein the roller loading position and the end face processing position are situated opposite to each other by 180 degrees across an axis of the carrier ring, and wherein the workpiece feeder for roller end face processing further comprises a roller unloading position, at which the roller is unloadable along the axial direction of the roller in parallel to the axial direction of the carrier ring, the roller unloading position being situated at a position spaced apart from the end face processing position by 90 degrees along a rotation direction of the carrier ring.

4. A workpiece feeder for roller end face processing according to claim 1, wherein the rotational force applying means applies the rotational force by driving a belt.

5. A workpiece feeder for roller end face processing according to claim 1, wherein the rotational force applying means applies the rotational force by driving a roller.

6. A roller end face processing machine, comprising:

the workpiece feeder for roller end face processing according to claim 1; and a double-head grinder comprising a pair of grinding stones for grinding the end faces of the roller.

7. A roller end face processing machine, comprising:

the workpiece feeder for roller end face processing according to claim 1; and a cup grinding stone for grinding the end faces of the roller.

8. A roller for a rolling bearing, which is obtained by processing both end faces thereof in the roller end face processing machine according to claim 6.

* * * * *